US009707670B2

(12) United States Patent
Hita

(10) Patent No.: US 9,707,670 B2
(45) Date of Patent: Jul. 18, 2017

(54) MOTOR-DRIVEN SCREWDRIVER

(71) Applicant: NITTO KOHKI CO., LTD., Tokyo (JP)

(72) Inventor: Hirokazu Hita, Tokyo (JP)

(73) Assignee: Nitto Kohki Co., Ltd., Tokyo (JP)

( * ) Notice: Subject to any disclaimer, the term of this patent is extended or adjusted under 35 U.S.C. 154(b) by 0 days.

(21) Appl. No.: 15/096,513

(22) Filed: Apr. 12, 2016

(65) Prior Publication Data

US 2016/0221165 A1 Aug. 4, 2016

Related U.S. Application Data

(63) Continuation of application No. PCT/JP2014/077913, filed on Oct. 21, 2014.

(30) Foreign Application Priority Data

Oct. 22, 2013 (JP) ..... 2013-219437

(51) Int. Cl.
*G08B 1/08* (2006.01)
*B25B 23/00* (2006.01)
(Continued)

(52) U.S. Cl.
CPC ..... *B25B 23/00* (2013.01); *B25B 21/00* (2013.01); *B25B 23/147* (2013.01); *B25F 5/00* (2013.01); *G08B 5/36* (2013.01); *G08C 19/38* (2013.01)

(58) Field of Classification Search
CPC ..... B25B 23/00; B25F 1/00
(Continued)

(56) References Cited

U.S. PATENT DOCUMENTS 4,483,072 A 11/1984 Nagashima et al.
7,613,590 B2 * 11/2009 Brown ..... A61B 5/0002 340/500
(Continued)

FOREIGN PATENT DOCUMENTS

DE 32 36 478 2/1984
EP 1 211 030 6/2002
(Continued)

OTHER PUBLICATIONS

International Search Report issued Jan. 6, 2015 in International (PCT) Application No. PCT/JP2014/077913.
(Continued)

*Primary Examiner* — Toan N Pham
(74) *Attorney, Agent, or Firm* — Wenderoth, Lind & Ponack, L.L.P.

(57) ABSTRACT

A motor-driven screwdriver accessory is externally attached to a motor-driven screwdriver body. The body has a drive control circuit disposed in a screwdriver housing, a power supply cord connected to the drive control circuit and extended through a first power supply cord holding hole, and a securing annular member secured to the outer periphery of the power supply cord. The accessory has a housing having a second power supply cord holding hole sized to allow the securing annular member to be engagingly secured thereto. The first power supply cord holding hole has a size allowing formation of a clearance between the first power supply cord holding hole and the power supply cord in a state where the power supply cord securing annular member is secured to the second power supply cord holding hole, thereby enabling a signal line from the drive control circuit to be routed through the clearance.

7 Claims, 9 Drawing Sheets

(51) Int. Cl.

| | |
|---|---|
| ***B25F 5/00*** | (2006.01) |
| ***B25B 21/00*** | (2006.01) |
| ***B25B 23/147*** | (2006.01) |
| ***G08B 5/36*** | (2006.01) |
| ***G08C 19/38*** | (2006.01) |

(58) Field of Classification Search
USPC ..... 340/533, 679, 680, 691.1, 694.6, 693.5, 340/693.9; 7/107, 108, 165; 362/119, 362/120, 800
See application file for complete search history.

(56) References Cited

U.S. PATENT DOCUMENTS

| | | | | |
|---|---|---|---|---|
| 2002/0144832 | A1 | 10/2002 | Brandstrom et al. | |
| 2004/0182587 | A1 | 9/2004 | May et al. | |
| 2009/0013477 | A1* | 1/2009 | Agronin | B25B 7/00 7/107 |
| 2010/0315804 | A1* | 12/2010 | Nishikimi | B25F 5/021 362/119 |

FOREIGN PATENT DOCUMENTS

| | | |
|---|---|---|
| JP | 59-17902 | 2/1984 |
| JP | 6-83272 | 11/1994 |
| JP | 9-76166 | 3/1997 |
| JP | 2002-254354 | 9/2002 |
| JP | 2003-53678 | 2/2003 |
| JP | 2012-35339 | 2/2012 |

OTHER PUBLICATIONS

Extended European Search Report issued Apr. 26, 2017 in European Application No. 14856418.0.

* cited by examiner (a)

(b)

(c)

(a)

(b)

(c)

MOTOR-DRIVEN SCREWDRIVER

TECHNICAL FIELD

The present invention relates to motor-driven screwdrivers. More specifically, the present invention relates to a motor-driven screwdriver configured such that a signal line for taking out a required signal related to an operation of the motor-driven screwdriver from a motor-driven screwdriver drive control circuit in the motor-driven screwdriver can be provided without applying additional machining to the housing of the motor-driven screwdriver.

BACKGROUND ART

There is known a motor-driven screwdriver having an indicating device that informs a worker about the drive status of the motor-driven screwdriver (Patent Literature 1). The known motor-driven screwdriver has a motor-driven screwdriver body equipped with an LED indicating that the associated motor is being driven and another LED indicating a state where the motor has been stopped due to the generation of torque greater than a specified value, thereby enabling visual confirmation of the motor drive status.

There is also a motor-driven screwdriver that, unlike the above-described motor-driven screwdriver, does not incorporate an indicator therein, but in which a signal line for taking out a required signal from a motor-driven screwdriver drive control circuit in the motor-driven screwdriver is led out of the motor-driven screwdriver, and information based on the electric signal is indicated on an indicator provided outside the motor-driven screwdriver body (Patent Literature 2). In this motor-driven screwdriver, tightening torque in a screw tightening operation of the motor-driven screwdriver is measured, and a control device outputs a signal indicating whether the screw tightening operation is a success or failure on the basis of the measured torque value. The success-failure signal is transmitted to the outside of the motor-driven screwdriver through the signal line, and a result of success or failure is indicated on an LED indication part.

Not all users using motor-driven screwdrivers require operation information such as the above-described information representing the motor drive status of a motor-driven screwdriver and information indicating whether screw tightening is a success or failure. Even if such information is required, pieces of required information differ for each user in most cases. Therefore, in order to meet each user's individual demand, conventional practice is to manufacture motor-driven screwdrivers as specially ordered products which enable a required signal to be taken out, or which have a function of indicating required information. There is also a case where a user wants to take out a required signal from an already used motor-driven screwdriver. In such a case, it is necessary to lead out a signal line for transmitting a signal related to an operation of the motor-driven screwdriver by applying additional machining to the motor-driven screwdriver body to provide a hole for leading out the signal line to the outside of the motor-driven screwdriver body.

CITATION LIST

Patent Literature

Patent Literature 1: Japanese Unexamined Utility Model Application Publication No. Hei 6-83272

Patent Literature 2: Japanese Unexamined Patent Application Publication No. 2003-53678

SUMMARY OF INVENTION

Technical Problem

However, a complicated, time- and labor-consuming operation is required to add an information indicating function to a motor-driven screwdriver or to lead out a signal line to the outside by the above-described method. Accordingly, it has been desired to facilitate the operation of adding an information indicating function to a motor-driven screwdriver or the operation of leading out a signal line to the outside.

Accordingly, an object of the present invention is to enable a signal line to be led out from an existing motor-driven screwdriver by a simple operation.

Solution to Problem

The present invention provides a motor-driven screwdriver including a motor-driven screwdriver body and a motor-driven screwdriver accessory to be externally attached to the motor-driven screwdriver body. The motor-driven screwdriver body includes a screwdriver housing, a motor-driven screwdriver drive control circuit disposed in the screwdriver housing, a first power supply cord holding hole provided in the rear end surface of the screwdriver housing, a power supply cord connected to the motor-driven screwdriver drive control circuit and extended to the outside of the screwdriver housing through the first power supply cord holding hole, and a power supply cord securing annular member secured to the outer periphery of the power supply cord. The motor-driven screwdriver accessory includes an accessory housing to be secured to the rear end portion of the screwdriver housing. The accessory housing has a second power supply cord holding hole of a size allowing passage of the power supply cord extending from the motor-driven screwdriver body and also enabling the power supply cord securing annular member to be engagingly secured to the second power supply cord holding hole. The first power supply cord holding hole has a size allowing formation of a clearance between the first power supply cord holding hole and the power supply cord extended through the first power supply cord holding hole in a state where the power supply cord securing annular member is secured to the second power supply cord holding hole, thereby enabling a signal line for taking out a required signal from the motor-driven screwdriver drive control circuit to be routed through the clearance.

In the motor-driven screwdriver of the present invention, when a required signal is desired to be taken out from the motor-driven screwdriver drive control circuit, the signal line can be led out through the clearance formed between the first power supply cord holding hole and the power supply cord. Therefore, unlike the above-described prior art, the motor-driven screwdriver of the present invention need not apply additional machining to the screwdriver housing to provide a hole for passing the signal line, and it becomes possible to easily lead out the signal line to the outside.

Preferably, the arrangement may be as follows. The power supply cord securing annular member is shaped to be secured in engagement with the first power supply cord holding hole of the screwdriver housing. The power supply cord has a length sufficient to be extended out of the screwdriver housing so that the power supply cord securing annular member removed from the first power supply cord holding hole can be secured in engagement with the second power supply cord holding hole of the accessory housing when attached to the motor-driven screwdriver body.

With the above-described structure, the same power supply cord can be used before and after the motor-driven screwdriver accessory is attached to the motor-driven screwdriver body. Therefore, when attaching the motor-driven screwdriver accessory to the motor-driven screwdriver body, there is no need to replace the power supply cord with another or to extend the length of the power supply cord.

Preferably, the motor-driven screwdriver accessory may further include an indication control circuit disposed in the accessory housing, the indication control circuit being connected to at least one circuit selected from between the motor-driven screwdriver drive control circuit and an external control circuit outside the motor-driven screwdriver to transmit a signal related to an operation of the motor-driven screwdriver on the basis of a signal received from the at least one circuit, and an operation information indicating part provided in the accessory housing to indicate information related to the operation of the motor-driven screwdriver upon receiving the signal related to the operation of the motor-driven screwdriver, which is transmitted from the indication control circuit.

Specifically, the indication control circuit and the motor-driven screwdriver drive control circuit may be connected by the signal line disposed to extend through the clearance in the first power supply cord holding hole.

By giving the motor-driven screwdriver accessory the function of indicating information related to an operation of the motor-driven screwdriver, it becomes possible for a worker to confirm the information more easily and surely.

Preferably, the arrangement may be as follows. The rear end portion of the screwdriver housing is provided with a suspension hole for suspending the motor-driven screwdriver body, and the accessory housing has a through-hole extending therethrough from the outer peripheral surface to the inner peripheral surface thereof. The motor-driven screwdriver further includes a connecting member inserted into the suspension hole through the through-hole to connect together the accessory housing and the rear end portion of the screwdriver housing.

Specifically, the arrangement may be as follows. The through-hole of the accessory housing has an internal thread, and the connecting member is an externally threaded member engageable with the internal thread.

By using the suspension hole, which has already been provided for attaching a suspension hook, to connect the screwdriver housing and the accessory housing, it becomes possible to connect the motor-driven screwdriver accessory to the motor-driven screwdriver body without applying additional machining to the motor-driven screwdriver body.

Preferably, the accessory housing may have a suspension hole for securing a suspension hook.

The suspension hook is, usually, attached to the rear end portion of the motor-driven screwdriver. In this regard, even when the suspension hook becomes unable to be attached to the motor-driven screwdriver body due to the fact that the motor-driven screwdriver accessory is externally attached to the rear end portion of the motor-driven screwdriver body, the suspension hook can be attached to the motor-driven screwdriver accessory instead; therefore, the motor-driven screwdriver can be suspended from a predetermined position by using the suspension hook.

A motor-driven screwdriver according to the present invention will be explained below on the basis of the accompanying drawings

DESCRIPTION OF EMBODIMENTS

Figure 1:
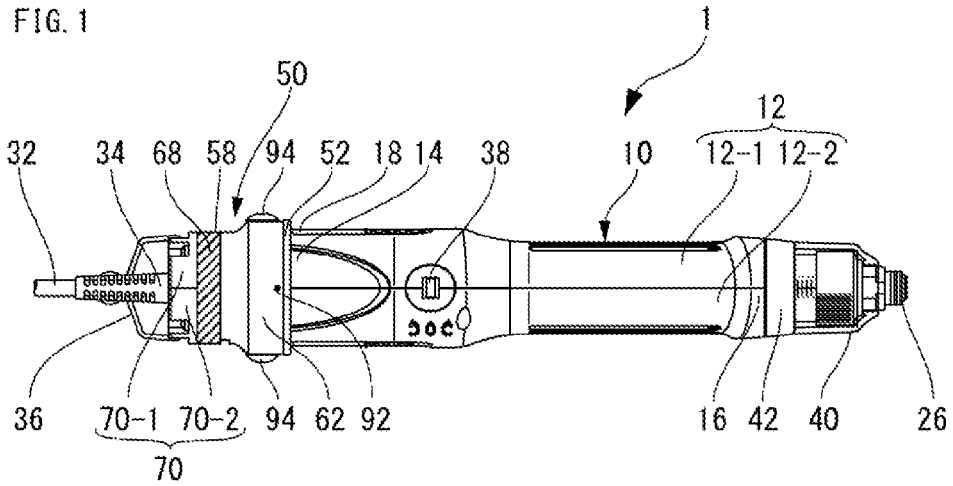
FIG. 1 is a top view of a motor-driven screwdriver according to the present invention.
Figure 2:
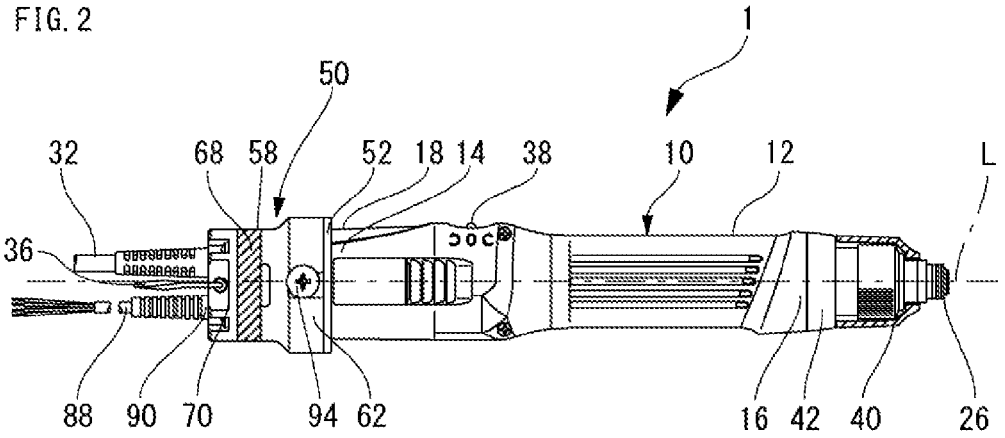
FIG. 2 is a side view of the motor-driven screwdriver shown in FIG. 1.

A motor-driven screwdriver 1 according to the present invention comprises, as shown in FIGS. 1 and 2, a motor-driven screwdriver body 10 and a motor-driven screwdriver accessory 50 externally attached to a rear end portion 14 of the motor-driven screwdriver body 10. The motor-driven screwdriver accessory 50 is configured to fixedly hold a power supply cord securing annular member 34 of a power supply cord 32, which has been detached from the motor-driven screwdriver body 10, as will be explained later.

Figure 3:
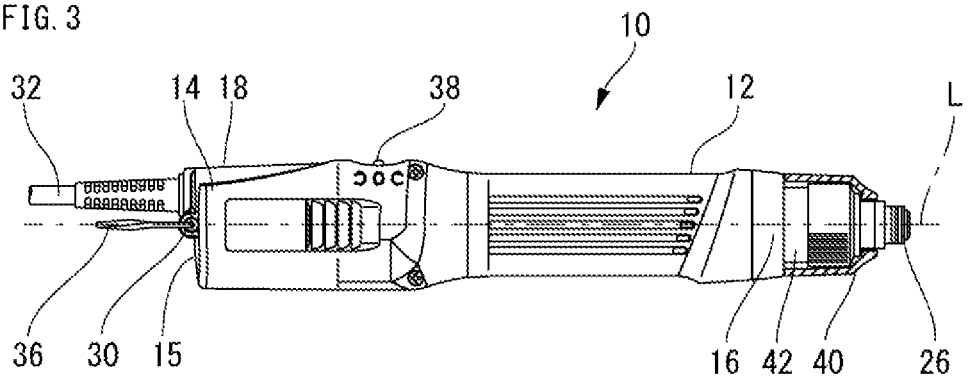
FIG. 3 is a side view of a motor-driven screwdriver body.
Figure 4:
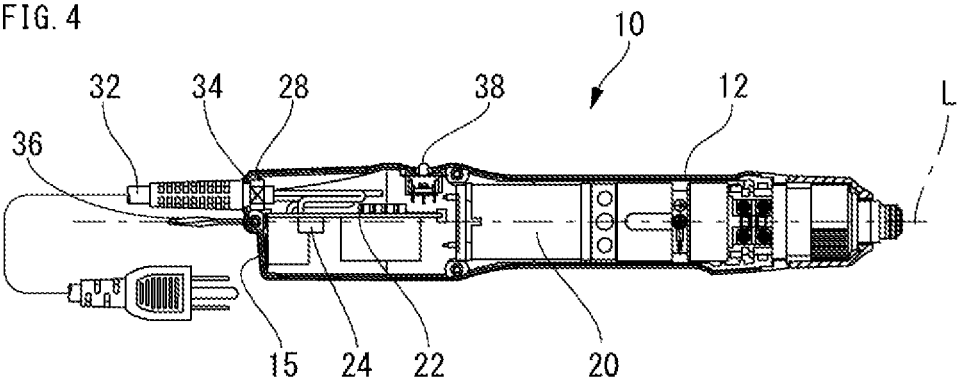
FIG. 4 is a sectional view of the motor-driven screwdriver body shown in FIG. 3.

The motor-driven screwdriver body 10, to which the motor-driven screwdriver accessory 50 is to be attached, has, as shown in FIGS. 3 and 4, a tubular screwdriver housing 12, a motor 20 disposed in the screwdriver housing 12, and a motor-driven screwdriver drive control circuit 22 for drive-controlling the motor 20. The screwdriver housing 12 has a front end portion 16 provided with a bit holder 26 driven to rotate by the motor 20. The bit holder 26 is configured to be fitted with a screwdriver bit (not shown). The screwdriver housing 12 has a rear end surface 15 formed with a power supply cord holding hole 28 for holding a power supply cord 32. A power supply cord securing annular member 34, which is secured to the outer periphery of the power supply cord 32, is engagingly secured to the power supply cord holding hole 28, thereby allowing the power supply cord 32 to be held so as not to come out of the screwdriver housing 12. A part of the power supply cord 32 that extends from the motor-driven screwdriver drive control circuit 22 to the power supply cord securing annular member 34 is folded in the screwdriver housing 12 and thus disposed with a sufficient margin of length. The rear end portion 14 of the screwdriver housing 12 has two suspension holes 30 formed at mutually opposing positions so as to extend inwardly from an outer peripheral surface 18 of the screwdriver housing 12 perpendicularly to a longitudinal axis L of the screwdriver housing 12. The two suspension holes 30 are fitted with a suspension hook 36 for suspending the motor-driven screwdriver body 10. The screwdriver housing 12 is further provided with a selector switch 38 to enable the motor-driven screwdriver 1 to be operated from the outside of the screwdriver housing 12. The selector switch 38 is connected to the motor-driven screwdriver drive control circuit 22 to allow the driving direction of the motor 20 to be changed over among "forward", "reverse", and "neutral" by actuating the selector switch 38. The motor 20 is driven to rotate when the motor-driven screwdriver body 10 is operated so that a screwdriver bit held by the bit holder 26 is pushed in. When the motor 20 is driven forward, the bit holder 26 rotates in a direction for tightening a right-hand screw; when the motor 20 is driven reversely, the bit holder 26 rotates in a direction for loosening a right-hand screw. When the selector switch 38 is in the neutral position, the motor 20 is not driven.

Figure 5:
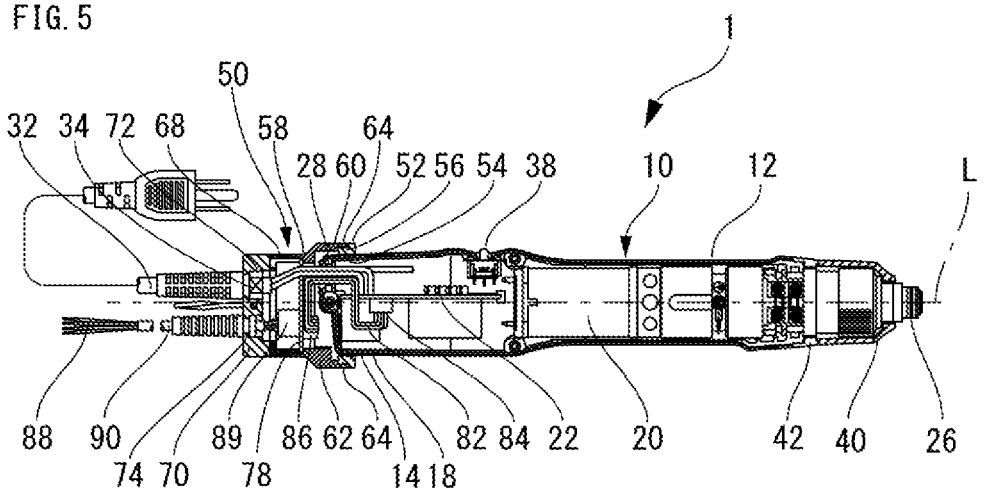
FIG. 5 is a sectional view of the motor-driven screwdriver shown in FIG. 2.
Figure 10:
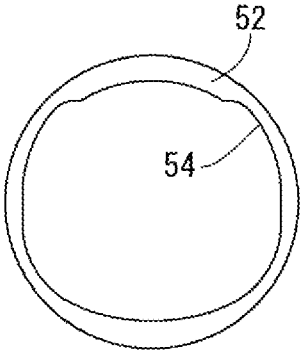
FIG. 10 is a diagram showing supporting and securing members having respective configurations conforming to the outer peripheral surfaces of the rear end portions of the various motor-driven screwdriver bodies shown in FIG. 8.
Figure 10:
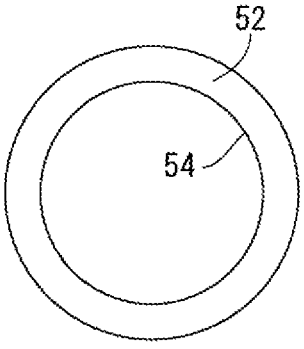
Figure 10:
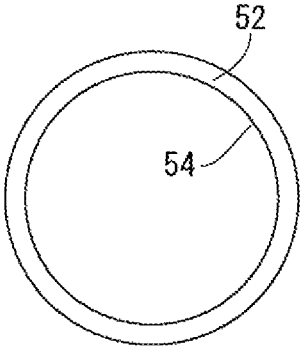

The motor-driven screwdriver accessory 50, which is to be externally attached to the rear end portion 14 of the motor-driven screwdriver body 10 has, as shown in FIGS. 1, 2 and 5, an accessory housing 58 to be secured to the screwdriver housing 12 of the motor-driven screwdriver body 10, a ring-shaped supporting and securing member 52 to be secured to the outer peripheral surface 18 of the rear end portion 14 of the motor-driven screwdriver body 10, and an indication control circuit 78 disposed in the accessory housing 58. The supporting and securing member 52 has an inner peripheral surface 54 conforming in shape to the outer peripheral surface 18 of the rear end portion 14 of the screwdriver housing 12 (FIG. 10), so that no gap will be formed between the inner peripheral surface 54 of the supporting and securing member 52 and the outer peripheral surface 18 of the rear end portion 14 of the screwdriver housing 12 when the supporting and securing member 52 is secured to the screwdriver housing 12, as will be explained later. The supporting and securing member 52 has a supporting and securing part 56 with a stepped configuration formed on the outer peripheral surface thereof. The accessory housing 58 has a securing part 60 with a stepped configuration formed on the inner peripheral surface thereof. The accessory housing 58 and the supporting and securing member 52, which has a ring-like shape, are secured to each other with the securing part 60 of the accessory housing 58 and the supporting and securing part 56 of the supporting and securing member 52 fitted to each other in the axial direction of the supporting and securing member 52.

The accessory housing 58 has a circular cylindrical accessory housing body 62 to be fitted to the supporting and securing member 52, a light-transmitting ring 68 formed of a light-transmitting transparent material, and a cord holding member 70. The accessory housing 58 is formed by screw-fixing the accessory housing body 62 and the cord holding member 70 to each other with the light-transmitting ring 68 held therebetween, as will be explained later. The indication control circuit 78 is provided with an LED. The LED emits light in response to a signal from the indication control circuit 78. Light from the LED is visible from the outside of the motor-driven screwdriver accessory 50 through the light-transmitting ring 68. The light-transmitting ring functions as an operation information indicating part.

Figure 6:
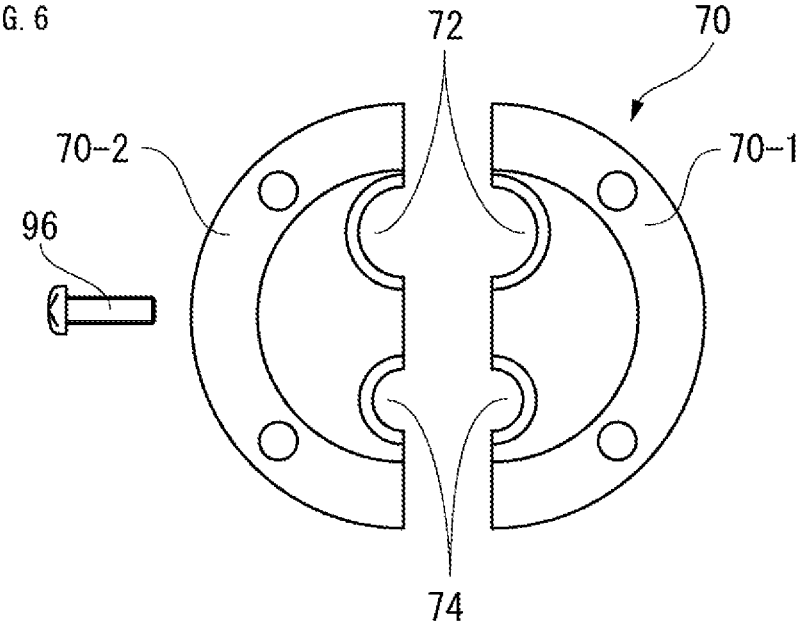
FIG. 6 is a diagram showing a cord holding member.
Figure 7A:
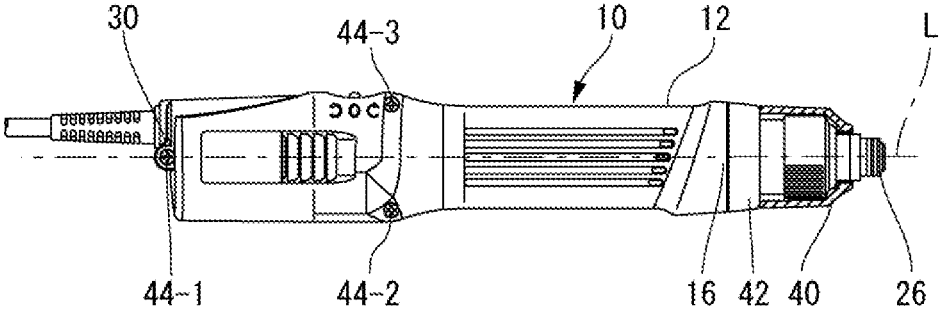
FIG. 7A is a first diagram showing a procedure for attaching a motor-driven screwdriver accessory to the motor-driven screwdriver body.
Figure 7B:
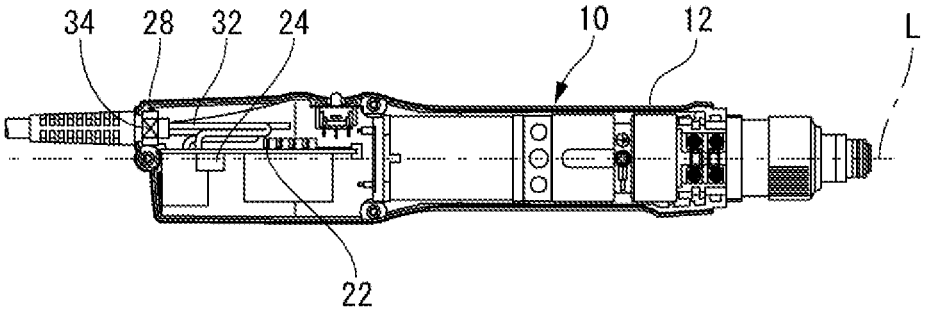
FIG. 7B is a second diagram showing the procedure for attaching the motor-driven screwdriver accessory to the motor-driven screwdriver body.
Figure 7C:
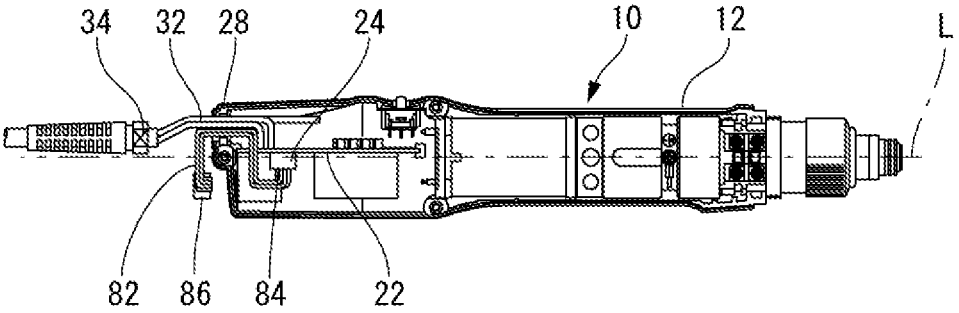
FIG. 7C is a third diagram showing the procedure for attaching the motor-driven screwdriver accessory to the motor-driven screwdriver body.
Figure 7D:
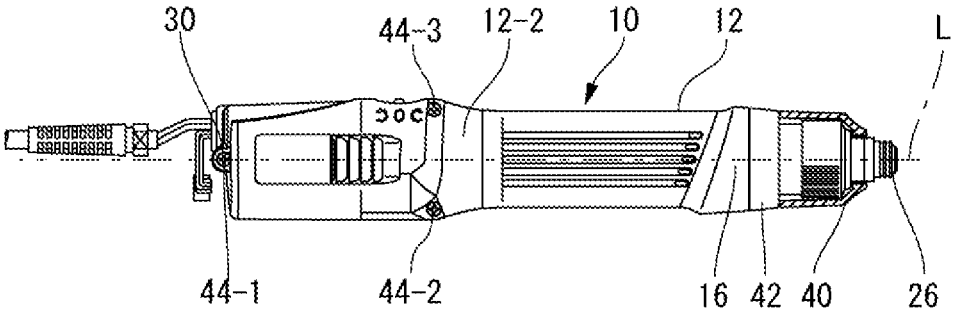
FIG. 7D is a fourth diagram showing the procedure for attaching the motor-driven screwdriver accessory to the motor-driven screwdriver body.
Figure 7E:
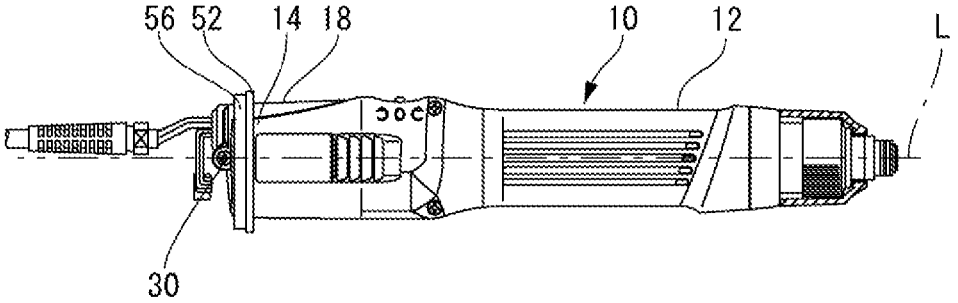
FIG. 7E is a fifth diagram showing the procedure for attaching the motor-driven screwdriver accessory to the motor-driven screwdriver body.
Figure 7F:
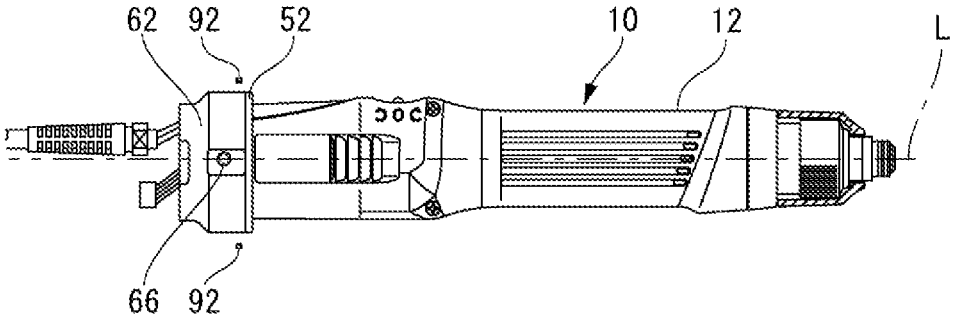
FIG. 7F is a sixth diagram showing the procedure for attaching the motor-driven screwdriver accessory to the motor-driven screwdriver body.
Figure 7G:
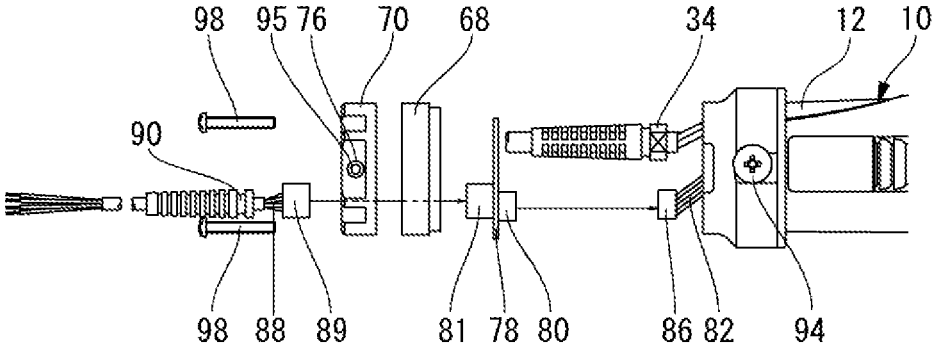
FIG. 7G is a seventh diagram showing the procedure for attaching the motor-driven screwdriver accessory to the motor-driven screwdriver body.
Figure 7H:
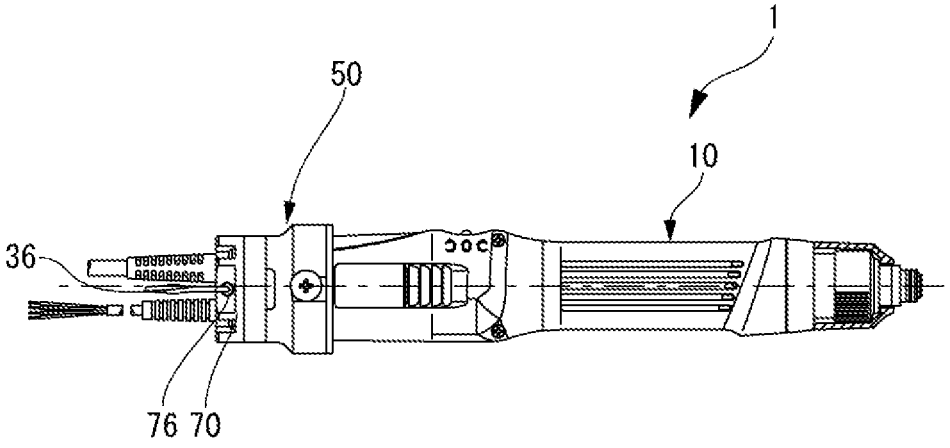
FIG. 7H is an eighth diagram showing the procedure for attaching the motor-driven screwdriver accessory to the motor-driven screwdriver body.

When the motor-driven screwdriver accessory 50 is externally attached to the rear end portion 14 of the motor-driven screwdriver body 10, as shown in FIG. 5, the power supply cord securing annular member 34 has been detached from the power supply cord holding hole 28 of the screwdriver housing 12 and held by and secured to the cord holding member 70. The cord holding member 70 comprises, as shown in FIG. 6, a first member 70-1 and a second member 70-2. Between the first member 70-1 and the second member 70-2 is formed a power supply cord holding hole 72 for fixedly holding the power supply cord securing annular member 34. The power supply cord 32 held in the power supply cord holding hole 72 of the cord holding member 70 extends, as shown in FIG. 5, from the motor-driven screwdriver drive control circuit 22 in the screwdriver housing 12 through the power supply cord holding hole 28 in the screwdriver housing 12 and through the accessory housing 58. The motor-driven screwdriver drive control circuit 22 is provided with a signal output terminal 24 (FIG. 7B) for outputting a signal related to an operation of the motor-driven screwdriver body 10. On the other hand, the indication control circuit 78 is provided with an internal signal input terminal 80 (FIG. 7G) for receiving a signal from the motor-driven screwdriver body 10. An internal signal transmission signal line 82 connects between the signal output terminal 24 of the motor-driven screwdriver drive control circuit 22 and the internal signal input terminal 80 of the indication control circuit 78. The internal signal transmission signal line 82 is routed to extend through the power supply cord holding hole 28 in which a clearance is formed as a result of the removal of the power supply cord securing annular member 34. The indication control circuit 78 is further provided with an external signal input terminal 81 (FIG. 7G), to which is connected an external signal transmission signal line 88 for transmitting an external signal from the external control circuit. The external signal transmission signal line 88 has a transmission signal line securing annular member 90 secured to the outer periphery thereof. The annular member 90 is fixedly held in a signal line holding hole 74 (FIG. 6) formed between the first and second members 70-1 and 70-2 of the cord holding member 70, thereby holding the external signal transmission signal line 88. It should be noted that, although in this embodiment the power supply cord securing annular member 34 is secured to the coating of the power supply cord 32 and thus formed larger in diameter than the coating, the coating may be engaged directly with the power supply cord holding hole 28, thereby holding the power supply cord 32. In this case, the part of the coating that is engaged with the power supply cord holding hole 28 serves as a power supply cord securing annular part.

The motor-driven screwdriver drive control circuit 22 has a function of outputting from the signal output terminal 24 signals related to the operation of the motor-driven screwdriver 1, for example, signals indicating the following: the on/off status of the motor 20; the driving direction of the motor 20, i.e. "forward", "reverse", or "neutral", set through the selector switch 38; the completion of screw tightening; and the temperature of the motor 20. The external control circuit has a function of outputting an external signal, for example, a signal indicating which of a plurality of motor-driven screwdrivers connected to the external control circuit should be used, or a signal indicating which motor-driven screwdriver is usable. The indication control circuit 78 of the motor-driven screwdriver accessory 50 receives the above-described signals from the motor-driven screwdriver drive control circuit 22 and the external control circuit and indicates for the worker information related to the operation of the motor-driven screwdriver 1 according to the received signals by emitting the LED. Examples of information related to the operation of the motor-driven screwdriver 1 include the following: information indicating that the motor-driven screwdriver 1 is usable; information indicating the operating status of the motor-driven screwdriver body 10; information indicating the timing of inspection and repair of the motor-driven screwdriver body 10; and information indicating a state where the motor-driven screwdriver body 10 has been forcibly stopped. The information indicating that the motor-driven screwdriver 1 is usable is indicated based on a signal transmitted from the external control circuit. The information indicating the operating status specifically includes information indicating that the rotational drive of the bit holder 26 has been temporarily stopped due to the application of a specified torque to the bit holder 26 and hence screw tightening with a specified torque has been normally completed, and information indicating the status of the driving direction of the motor 20, i.e. "forward", "reverse", or "neutral", set on the selector switch 38. The information indicating the timing of inspection and repair is indicated, for example, on the following occasions: when the number of times of completion of screw tightening integrated from the start of use of the motor-driven screwdriver body 10 reaches a value greater than a specified value; when, in a case where the motor 20 of the motor-driven screwdriver body 10 is a brush motor, the brush of the brush motor has worn to a value less than a specified value; and when the motor 20 does not stop even when a specified torque is applied to the bit holder 26 and hence the rotational drive of the bit holder 26 does not stop. The information indicating the fact that the motor-driven screwdriver body 10 has been forcibly stopped is indicated, for example, when it is judged necessary to cool the motor 20 because the temperature of the motor 20 has risen to a level higher than a predetermined value.

In this embodiment, lighting/blinking of an LED is used as an operation information indicating method, but operation information may be indicated by using a display capable of displaying letters in place of the lighting/blinking of an LED. In this case, numerical values may be used to indicate the number of times at which screw tightening is normally completed, or to indicate the integrated value of the driving time of the motor 20, etc. as information related to the operation of the motor-driven screwdriver body 10. Alternatively, the above-described information to be informed to the worker may be indicated by using letters.

It should be noted that the number of pieces of information indicatable on the motor-driven screwdriver accessory 50 is not necessarily limited to one and that a plurality of pieces of information may be indicated simultaneously, for example, by providing the motor-driven screwdriver accessory 50 with a plurality of LEDs of different colors. In addition, the indication control circuit 78 is configured to enable the user to select and set information to be indicated according to his or her demand.

The indication control circuit 78 may have not only a function of transmitting signals related to the operation of the motor-driven screwdriver 1 but also a recording device for storing signals received from the motor-driven screwdriver drive control circuit 22 and the external control circuit as data and also a USB terminal or the like as a data output terminal for transferring the stored data to the outside. By taking out and analyzing the stored data, it is possible to supervise whether or not the worker is working efficiently. Specifically, when the number of times at which the motor 20 is driven reversely is large, the possibility is high that screw retightening has been performed many times; therefore, it is possible to judge that there have been a large number of errors in screw tightening. When the driving time of the motor 20 is long, it is possible to judge that the motor 20 has been uselessly driven for a long time. It is also possible to know that the timing of adjustment and repair of the motor-driven screwdriver body 10 is approaching, and hence possible to prepare a motor-driven screwdriver body 10 for replacement in advance of the timing of adjustment and repair. It should be noted that setting as to which information is to be indicated on the above-described motor-driven screwdriver accessory 50 can be made by connecting the above-described USB terminal to a computer and changing the setting on the indication control circuit 78 from the computer.

The cord holding member 70 of the accessory housing 58 has two mutually facing suspension holes 76 (see FIG. 7G) extending inwardly from the respective outer peripheral surfaces of the first and second members 70-1 and 70-2 perpendicularly to the longitudinal axis L. The two suspension holes 76 are configured to be fitted with the suspension hook 36, which has been detached from the motor-driven screwdriver body 10. It should be noted that the bottom surface of each of the suspension holes 76, which are to be fitted with the suspension hook 36, is provided with a threaded hole 95 extending toward the center of the cord holding member 70 to receive a screw 96 for connecting the first and second members 70-1 and 70-2 to each other.

Next, a procedure for externally attaching the motor-driven screwdriver accessory 50 to the motor-driven screwdriver body 10 will be explained with reference to FIGS. 7A to 7H. First, the suspension hook 36 (see FIG. 4) attached to the rear end portion 14 of the motor-driven screwdriver body 10 is removed from the suspension holes 30. Further, a circular cylindrical cover 40 and a coupling 42 are detached from the front end portion 16 of the motor-driven screwdriver body 10, and three screws 44-1, 44-2 and 44-3 connecting first and second housing members 12-1 and 12-2 (see FIG. 1), which constitute the screwdriver housing 12, are removed (see FIG. 7A) to detach the second housing member 12-2 from the first housing member 12-1 (see FIG. 7B). It should be noted that a threaded hole that receives the screw 44-1 is provided to extend from the bottom surface of each of the suspension holes 30, in which the suspension hook 36 is fitted, toward the center of the screwdriver housing 12. Next, the power supply cord securing annular member 34 is disengaged from the power supply cord holding hole 28 in the screwdriver housing 12, and the part of the power supply cord 32 which has been folded in the screwdriver housing 12 is pulled out from the power supply cord holding hole 28. In addition, a first end portion 84 of the internal signal transmission signal line 82 is connected to the signal output terminal 24 of the motor-driven screwdriver drive control circuit 22, and the internal signal transmission signal line 82 is disposed to extend through the power supply cord holding hole 28 (see FIG. 7C). The detached second housing member 12-2 is reattached to the first housing member 12-1, and the first and second housing members 12-1 and 12-2 are connected and secured to each other with the three screws 44-1, 44-2 and 44-3 (see FIG. 7D). Next, the ring-shaped supporting and securing member 52 is press-fitted and secured to the outer peripheral surface 18 of the rear end portion 14 of the screwdriver housing 12 (see FIG. 7E). The supporting and securing member 52 is secured to the screwdriver housing 12 with substantially no gap between the inner peripheral surface 54 of the supporting and securing member 52 and the outer peripheral surface 18 of the screwdriver housing 12 because the inner peripheral surface 54 of the supporting and securing member 52 conforms in shape to the outer peripheral surface 18 of the screwdriver housing 12, as has been stated above. It should be noted that the screwdriver housing 12 and the supporting and securing member 52 may be secured to each other by using an adhesive. Next, the accessory housing body 62 is attached to the supporting and securing member 52 so that securing part 60 of the accessory housing body 62 is axially fitted to the supporting and securing part 56 of the supporting and securing member 52 (see FIG. 7F). The securing part 60 of the accessory housing body 62 is provided with two threaded holes 64 (see FIG. 5) extending therethrough from the outer peripheral surface to the inner peripheral surface thereof. The accessory housing 58 and the supporting and securing member 52 are secured to each other by engaging setscrews 92 with the threaded holes 64. The accessory housing body 62 further has two threaded holes 66 provided at respective positions corresponding to the suspension holes 30 of the screwdriver housing 12 such that the threaded holes 66 extend through the accessory housing body 62 from the outer peripheral surface to the inner peripheral surface thereof. Connecting members 94 (see FIG. 7G) having external threads are engaged with the threaded holes 66, respectively, so as to project from the inner peripheral surface of the accessory housing body 62 and to extend into the suspension holes 30 of the screwdriver housing 12. With the connecting members 94, the accessory housing body 62 is connected to and supported by the screwdriver housing 12 and held so as not to come off the motor-driven screwdriver body 10. Next, a second end portion 86 of the internal signal transmission signal line 82 extending out of the screwdriver housing 12 is connected to the internal signal input terminal 80 of the indication control circuit 78 (see FIG. 7G). Further, a connecting terminal 89 of the external signal transmission signal line 88 is passed through the inside of the light-transmitting ring 68 and connected to the external signal input terminal 81 of the indication control circuit 78. Next, the first and second members 70-1 and 70-2 of the cord holding member 70 (see FIG. 6) are connected and secured to each other by engaging the screw 96 with the threaded hole 95, with the power supply cord securing annular member 34 and the transmission signal line securing annular member 90 held in the power supply cord holding hole 72 and the signal line holding hole 74, respectively. The connected and secured cord holding member 70 is secured to the accessory housing body 62 by using screws 98, with the indication control circuit 78 and the light-transmitting ring 68 held between the cord holding member 70 and the accessory housing body 62. Finally, the suspension hook 36 is attached to the suspension holes 76, thereby completing the operation of attaching the motor-driven screwdriver accessory 50 to the motor-driven screwdriver body 10 (see FIG. 7H).

Thus, the motor-driven screwdriver accessory 50 can be externally attached to an existing motor-driven screwdriver body 10 without applying additional machining to the motor-driven screwdriver body 10. In addition, assuming that the motor-driven screwdriver accessory 50 will be attached to the motor-driven screwdriver body 10, the power supply cord 32 is disposed in such a manner as to be folded in the screwdriver housing 12 so that, when pulled out of the screwdriver housing 12, the power supply cord 32 has a sufficient length to allow the power supply cord securing annular member 34 to be moved to the power supply cord holding hole 72 of the accessory housing 58. Accordingly, when attaching the motor-driven screwdriver accessory 50 to the motor-driven screwdriver body 10, there is no need for an operation such as replacing the power supply cord 32 with another or extending the length of the power supply cord 32. It should be noted that it is not always necessary to use the same power supply cord 32 before and after the motor-driven screwdriver accessory 50 is attached to the motor-driven screwdriver body 10, but the power supply cord 32 may be replaced with another when the motor-driven screwdriver accessory 50 is attached to the motor-driven screwdriver body 10. In this case, the power supply cord disposed in the motor-driven screwdriver body 10 before the motor-driven screwdriver accessory 50 is attached thereto need not be disposed with a sufficient margin of length, for example, by being folded as in this embodiment.

Figure 8:
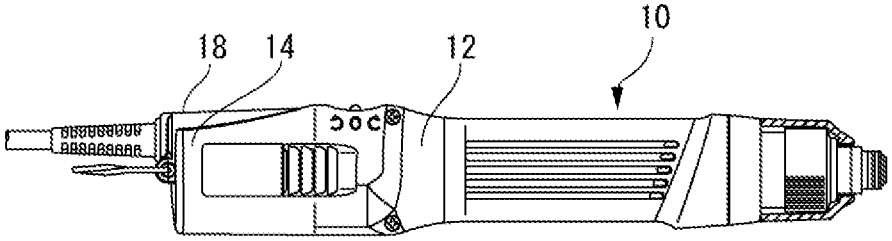
FIG. 8 is a diagram showing various motor-driven screwdriver bodies.
Figure 8:
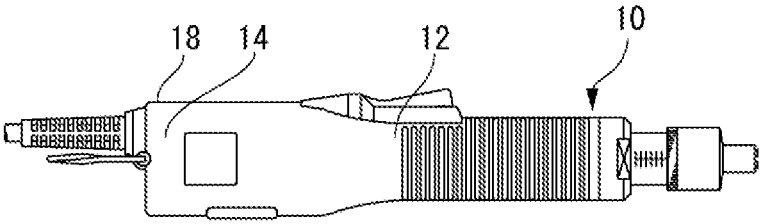
Figure 8:
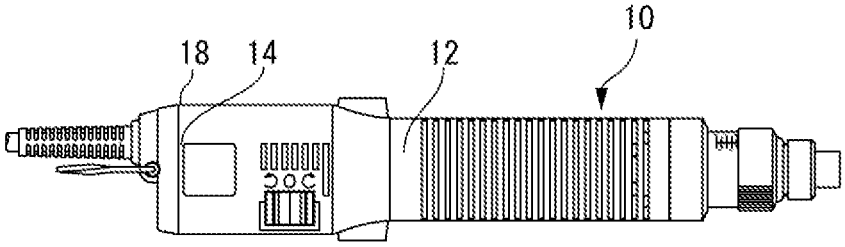
Figure 9:
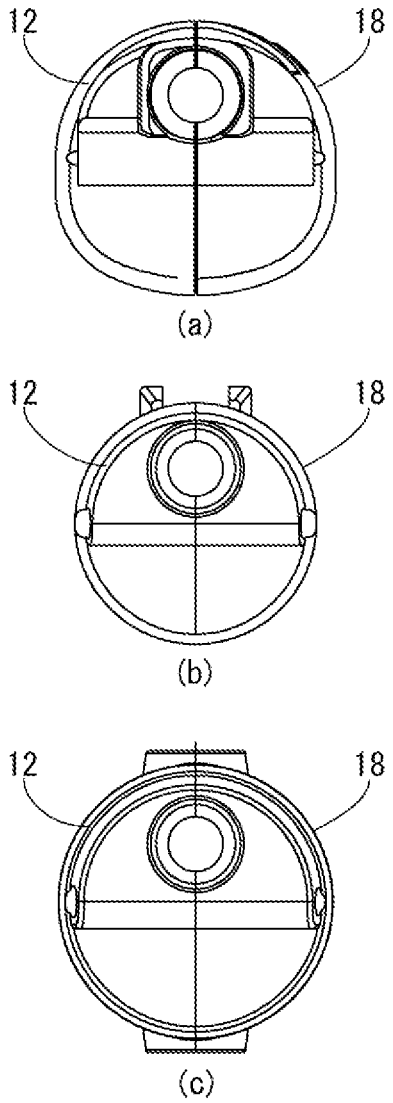
FIG. 9 is a sectional view of the rear end portions of the various motor-driven screwdriver bodies shown in FIG. 8.

Existing motor-driven screwdriver bodies 10 vary in size and shape as shown, for example, in FIGS. 8*a* to 8*c*. Accordingly, the outer peripheral surfaces 18 of the rear end portions 14 of the screwdriver housings 12 also vary in size and shape as shown, for example, in FIGS. 9*a* to 9*c*. Therefore, in order to externally attach an accessory, a plurality of accessory bodies usually need to be prepared in conformity with various configurations of motor-driven screwdrivers. With the motor-driven screwdriver accessory 50 according to the present invention, however, the supporting and securing member 52, which is engagingly secured directly to the outer peripheral surface 18 of the motor-driven screwdriver body 10, is a member separate from the accessory housing 58. Therefore, the accessory housing 58 can be used in common for motor-driven screwdriver bodies 10 of different configurations, provided that supporting and securing members 52 are prepared which have inner peripheral surfaces 54 conforming in shape to the outer peripheral surfaces 18 of various motor-driven screwdrivers as shown in FIGS. 10*a* to 10*c*. Thus, the motor-driven screwdriver accessory 50 of the present invention can be externally attached without a gap to various motor-driven screwdriver bodies 10 different in the shape of their outer peripheral surfaces 18 simply by preparing only supporting and securing members 52, which are relatively simple in structure, in conformity with the motor-driven screwdriver bodies 10.

In the above-described embodiment, an LED, which is a light-emitting display element, is used as an operation information indicating part indicating information related to the operation of the motor-driven screwdriver 1, thereby visually indicating the information. It should, however, be noted that the operation information indicating part may comprise other light-emitting display elements. It is also possible to use audio indications. Further, although the indication control circuit 78 is connected to both the motor-driven screwdriver drive control circuit 22 and the external control circuit, the indication control circuit 78 may be connected to only one of the two circuits. Further, the supporting and securing member 52 need not necessarily have a ring shape. The supporting and securing member 52 may have any shape that can securely support the accessory housing 58. The supporting and securing member 52 may be formed as a member integrated with the screwdriver housing 12. Alternatively, the supporting and securing member 52 may be formed as a member integrated with the accessory housing body 62.

Although in the above-described embodiment the supporting and securing member 52 is secured to the outer peripheral surface 18 of the screwdriver housing 12 by press-fitting, the supporting and securing member 52 need not necessarily be firmly secured to the outer peripheral surface 18 of the screwdriver housing 12 because the accessory housing 58, which is secured to the supporting and securing member 52, is supported by the connecting members 94 so as not to come off the screwdriver housing 12. The supporting and securing member 52 may be configured to only engage the outer peripheral surface 18 of the screwdriver housing 12 so that the accessory housing 58 will not tilt about an axis defined by the connecting members 94.

LIST OF REFERENCE SIGNS

Motor-driven screwdriver 1; motor-driven screwdriver body 10; screwdriver housing 12; first housing member 12-1; second housing member 12-2; rear end portion 14; rear end surface 15; front end portion 16; outer peripheral surface 18; motor 20; motor-driven screwdriver drive control circuit 22; signal output terminal 24; bit holder 26; power supply cord holding hole 28; longitudinal axis L; suspension holes 30; power supply cord 32: power supply cord securing annular member 34; suspension hook 36; selector switch 38; cover 40; coupling 42; screws 44; motor-driven screwdriver accessory 50; supporting and securing member 52; inner peripheral surface 54; supporting and securing part 56; accessory housing 58; securing part 60; accessory housing body 62; threaded holes 64; threaded holes 66; operation information indicating part, light-transmitting ring 68; cord holding member 70; first member 70-1; second member 70-2; power supply cord holding hole 72; signal line holding hole 74; suspension holes 76; indication control circuit 78; internal signal input terminal 80; external signal input terminal 81; internal signal transmission signal line 82; first end portion 84; second end portion 86; external signal transmission signal line 88; connecting terminal 89; transmission signal line securing annular member 90; setscrews 92; connecting members 94; threaded hole 95; screw 96; screws 98.

The invention claimed is:

1. A motor-driven screwdriver comprising a motor-driven screwdriver body and a motor-driven screwdriver accessory to be externally attached to the motor-driven screwdriver body;

the motor-driven screwdriver body including:

a screwdriver housing;

a motor-driven screwdriver drive control circuit disposed in the screwdriver housing;

a first power supply cord holding hole provided in a rear end surface of the screwdriver housing;

a power supply cord connected to the motor-driven screwdriver drive control circuit and extended to an outside of the screwdriver housing through the first power supply cord holding hole; and a power supply cord securing annular member secured to an outer periphery of the power supply cord;

the motor-driven screwdriver accessory including an accessory housing to be secured to a rear end portion of the screwdriver housing, the accessory housing having a second power supply cord holding hole of a size allowing passage of the power supply cord extending from the motor-driven screwdriver body and also enabling the power supply cord securing annular member to be engagingly secured to the second power supply cord holding hole;

wherein the first power supply cord holding hole has a size allowing formation of a clearance between the first power supply cord holding hole and the power supply cord extended through the first power supply cord holding hole in a state where the power supply cord securing annular member is secured to the second power supply cord holding hole, thereby enabling a signal line for taking out a required signal from the motor-driven screwdriver drive control circuit to be routed through the clearance.

2. The motor-driven screwdriver of claim 1, wherein the power supply cord securing annular member is shaped to be secured in engagement with the first power supply cord holding hole of the screwdriver housing;

the power supply cord having a length sufficient to be extended out of the screwdriver housing so that the power supply cord securing annular member removed from the first power supply cord holding hole can be secured in engagement with the second power supply cord holding hole of the accessory housing when attached to the motor-driven screwdriver body.

3. The motor-driven screwdriver of claim 1 or 2, wherein the motor-driven screwdriver accessory further includes:

an indication control circuit disposed in the accessory housing, the indication control circuit being connected to at least one circuit selected from between the motor-driven screwdriver drive control circuit and an external control circuit outside the motor-driven screwdriver to transmit a signal related to an operation of the motor-driven screwdriver on a basis of a signal received from the at least one circuit; and an operation information indicating part disposed in the accessory housing to indicate information related to the operation of the motor-driven screwdriver upon receiving the signal related to the operation of the motor-driven screwdriver, which is transmitted from the indication control circuit.

4. The motor-driven screwdriver of claim 3, wherein the indication control circuit and the motor-driven screwdriver drive control circuit are connected by the signal line disposed to extend through the clearance in the first power supply cord holding hole.

5. The motor-driven screwdriver of claim 1, wherein the rear end portion of the screwdriver housing is provided with a suspension hole for suspending the motor-driven screwdriver body;

the accessory housing having a through-hole extending therethrough from an outer peripheral surface to an inner peripheral surface thereof;

the motor-driven screwdriver further comprising:

a connecting member inserted into the suspension hole through the through-hole to connect together the accessory housing and the rear end portion of the screwdriver housing.

6. The motor-driven screwdriver of claim 5, wherein the through-hole of the accessory housing has an internal thread, and the connecting member is an externally threaded member engageable with the internal thread.

7. The motor-driven screwdriver of claim 1, wherein the accessory housing has a suspension hole for securing a suspension hook.

* * * * *